US008899297B2

(12) United States Patent
Mazej et al.

(10) Patent No.: US 8,899,297 B2
(45) Date of Patent: Dec. 2, 2014

(54) ROLLING DOOR, IN PARTICULAR FAST-MOVING INDUSTRIAL DOOR

(75) Inventors: Andrej Mazej, Ljubljana (SI); Joze Breznikar, Vrhnika (SI)

(73) Assignee: Efaflex Inzeniring D.O.O. Ljubljana (SI)

( * ) Notice: Subject to any disclaimer, the term of this patent is extended or adjusted under 35 U.S.C. 154(b) by 422 days.

(21) Appl. No.: 12/943,658

(22) Filed: Nov. 10, 2010

(65) Prior Publication Data

US 2011/0146920 A1 Jun. 23, 2011

(30) Foreign Application Priority Data

Nov. 10, 2009 (DE) ..... 10 2009 044 492

(51) Int. Cl.
*E06B 9/15* (2006.01)

(52) U.S. Cl.
USPC ..... 160/133; 160/310; 160/265

(58) Field of Classification Search
USPC ..... 160/133, 310, 193, 265, 321
See application file for complete search history.

(56) References Cited

U.S. PATENT DOCUMENTS

| | | | | | |
|---|---|---|---|---|---|
| 1,183,402 | A * | 5/1916 | Prescott | 160/193 |
| 2,754,899 | A * | 7/1956 | Karobonik et al. | 160/23.1 |
| 4,947,937 | A * | 8/1990 | Searer et al. | 160/133 |
| D333,776 | S * | 3/1993 | Cloutier | D8/358 |
| 5,484,007 | A * | 1/1996 | Rejc | 160/133 |
| 5,488,982 | A * | 2/1996 | Rejc | 160/133 |
| 5,682,937 | A * | 11/1997 | Decrane et al. | 160/133 |
| 6,119,758 | A * | 9/2000 | Coenraets | 160/273.1 |
| 6,766,845 | B2 * | 7/2004 | Rejc | 160/133 |
| 6,860,311 | B1 * | 3/2005 | Minor | 160/202 |
| 6,883,577 | B2 * | 4/2005 | Frede | 160/133 |
| 7,481,260 | B2 * | 1/2009 | Hagen | 160/265 |
| 7,798,198 | B2 * | 9/2010 | Rejc et al. | 160/133 |
| 7,810,544 | B2 * | 10/2010 | Spiess | 160/242 |
| 7,913,739 | B2 * | 3/2011 | Rejc et al. | 160/133 |
| 2003/0047291 | A1 * | 3/2003 | Klein | 160/133 |
| 2004/0163777 | A1 * | 8/2004 | Frede | 160/268.1 |
| 2005/0115688 | A1 * | 6/2005 | Frede | 160/268.1 |
| 2005/0252623 | A1 * | 11/2005 | McTavish et al. | 160/310 |
| 2008/0251220 | A1 * | 10/2008 | Rejc et al. | 160/266 |
| 2008/0295411 | A1 * | 12/2008 | Rejc et al. | 49/445 |
| 2011/0146920 | A1 * | 6/2011 | Mazej et al. | 160/311 |
| 2012/0312483 | A1 * | 12/2012 | Letonje et al. | 160/133 |

FOREIGN PATENT DOCUMENTS

| | | | |
|---|---|---|---|
| DE | 4015214 | A1 | 11/1991 |
| DE | 9300449 | U1 | 4/1993 |
| DE | 69219654 | T2 | 12/1997 |
| DE | 20002359 | U1 | 4/2001 |
| DE | 102005049584 | A1 | 5/2007 |
| WO | 9002056 | | 3/1990 |

* cited by examiner

*Primary Examiner* — Blair M. Johnson
(74) *Attorney, Agent, or Firm* — Wolff & Samson, PC

(57) ABSTRACT

A rolling door having a door leaf and guides arranged on both sides, each of which includes a vertical portion and a spiral portion, wherein the door leaf is received in the spiral portions in the form of non-contacting winding layers when the rolling door is in the opened condition. A drive mechanism for operating the rolling door has a motor, a drive shaft and drive organs. The drive organs are arranged on both sides of the door leaf and the drive shaft establishes a driving connection between the drive organs. In one embodiment, the drive shaft is arranged in the central area of the spiral portions of the guides of both sides and extends from one side of the door to the other. Hereby a rolling door is obtained whose structural height in the area of the door lintel is reduced while maintaining a small installation depth.

8 Claims, 3 Drawing Sheets

ROLLING DOOR, IN PARTICULAR FAST-MOVING INDUSTRIAL DOOR

This application claims benefit of priority of German Patent Application No. DE 10 2009 044 492.0 filed Nov. 10, 2009.

BACKGROUND

One manner of configuring such a rolling door has furthermore become known from DE 199 15 376 A1 where the spiral portions of the guides are configured as a circular spiral. This results in a smaller depth of construction space into the installation space of the rolling door. In addition to very high operating speeds, this door moreover enables very low-noise and low-energy operation.

Driving these rolling doors is generally achieved through traction means such as chains, toothed belts or the like circulating as drive organs on both sides of the door aperture in the door casements and attacking at a floor-side end portion of the door leaf, i.e., at the lower terminating member or at an adjacent slat, etc., where they introduce the drive force to the door leaf. Each drive organ is guided at its outer strand in such a way that the latter extends substantially within the plane of the door leaf, thus ensuring optimum introduction of force. To this end, the drive organs are deflected at the respective lower and upper ends of the rolling door with the aid of chain wheels or pulleys, etc. In this context, synchronous introduction of the drive energy to the door leaf is of particular importance, for which reason a driving connection between the drive organs having the form of a drive shaft is provided. In the case of a rolling door in accordance with DE 199 15 376 A1, this drive shaft directly interconnects the upper deflection rollers of the drive organs, so that the introduction of force is effected simultaneously, and jamming of the door leaf in the guides is avoided. In the area of a casement of the door arrangement, the drive shaft is driven by a motor which—in the case of an industrial door in accordance with DE 199 15 376 A1—is mostly arranged in the center of the circular spiral such as to project through the latter in a direction toward the other door side and thus avoid an additional lateral projecting length at the door arrangement. The motor is furthermore connected to the drive shaft by means of a toothed belt, a chain, or the like. This drive type is shown by way of example in DE 102 13 811 A1 where the fast-moving industrial door in accordance with DE 199 15 376 A1 is employed jointly with a fire-protection hanging.

SUMMARY

As will become evident from this representation, however, such a structure for the drive mechanism requires a certain construction space in the area of the door lintel above the circular spiral for arranging the drive shaft. This is frequently considered to be a drawback as it unfavorably adds to the required lintel height at the building, eventually resulting in a reduction of the headway of the door aperture. It is, however, desired for many purposes of use to keep the dimensions for the accommodation of the door leaf in the area of the door lintel as small as possible, with regard both to the structural height and the installation depth into the room.

The invention is therefore based on the object of further developing a generic rolling door such that its structural height in the area of the door lintel is reduced while at the same time maintaining a small installation depth.

In accordance with a first aspect of the invention, this object is achieved through a rolling door provided with: a door leaf which covers a door aperture when the rolling door is in the closed condition, guides arranged on both sides of the door leaf for guiding the door leaf in them, wherein the guides each comprise a vertical portion associated to the door aperture and a spiral portion associated to a door lintel, and wherein the door leaf is received in the spiral portions in the form of non-contacting winding layers when the rolling door is in the opened condition, and a drive mechanism for operating the rolling door which comprises a motor, a drive shaft and drive organs having the form of traction means such as toothed belts, chains or the like, wherein the drive organs are arranged on both sides of the door leaf laterally adjacent the guides and outside the moving range of the door leaf and act on a floor-side end portion of the door leaf for the purpose of introducing the drive force, wherein the drive organs extend substantially within the plane of the door leaf in the area of the vertical portions of the guides, and wherein the drive shaft establishes a driving connection between the drive organs, wherein the drive shaft is arranged in the central area of the spiral portions of the guides of both sides and extends from one side of the door to the other one, and wherein the drive organs are each deflected with the aid of deflection means such that the strand of the drive organs facing the door aperture substantially extends within the plane of the door leaf.

The invention thus avoids the drive shaft being guided outside of the coil. In this regard, it was realized in the framework of the invention that the free space present in the center of the spiral may be utilized immediately for accommodating the drive shaft without any resulting unfavorable interactions between the door leaf guided in the coil and the drive shaft. It is thus possible to achieve a particularly compact structure in the area of the coil at the rolling door of the invention, which has a favorable effect with regard to the required external dimensions thereof.

In particular, the upper deflection rollers for the drive organs may be placed in closer proximity of the spiral guide, for a continuous connection from one side of the door to the other one does not exist any more in this location. Inasmuch as guiding of the drive organs is moreover performed laterally adjacent the guides, no negative effects ensue during operation.

As a final result, the required structural height of the rolling door of the invention may be selected to be particularly small, so that it is accordingly also possible to realize a particularly low door lintel height.

This provides another advantage in that the installation depth of the rolling door arrangement into the useful space may at the same time equally be kept very small, for it is not affected by the position in accordance with the invention of the drive shaft. The installation depth thus is likewise substantially determined by the required external dimensions of the spiral portion. The present invention thus achieves optimized dimensioning of the system structure in the area of the door lintel.

This moreover does not involve any impairment of the excellent moving properties of such rolling doors, so that it is not necessary to subtract from either reliability, longevity, or convenience of use as compared with the prior art.

It is a further advantage that the drive organs are each deflected with the aid of deflection means such that they extend substantially within the plane of the door leaf in the area of the vertical portions of the guides. Despite this repositioning of the drive shaft, the invention thus achieves the effect that the strand of the drive organs introducing the drive force to the door leaf unfolds its effect within the plane of the door leaf, thus enabling an optimized introduction of force. In particular it is hereby made possible to reliably avoid jamming of the door leaf as well as damage to the latter as a result of friction losses etc. during its movement inside the lateral guide elements.

Drive organs provided in accordance with the invention are traction means such as toothed belts, chains, cables, straps or the like, which are guided over deflection means such as rollers, etc.

As the drive organs act on a floor-side end portion of the door leaf for the purpose of introducing the drive force, it is possible to utilize a drive type with the rolling door of the invention that is particularly reliable and has variously found acceptance in practice. This has a favorable effect on its reliability and longevity.

Using toothed belts as drive organs enables reliable force transmission and is also suited for long-term utilization in operation with deflective rollers, etc. They moreover allow a low-noise and low-friction use. Such toothed belts are in particular also suited for high-speed operation of the rolling door of the invention.

In this context DE 40 15 215 A1, for example, discloses a lifting door arrangement equally requiring only a relatively small structural height—which is determined by the external dimensions of the spiral portions of the guides—in the area of the door lintel. This is, however, to the detriment of the distance of the door leaf from the plane of the door aperture, for in accordance with this prior art the upper deflection roller is tilted toward the door aperture as compared with the generic prior art, and the traction organ, in that case a chain, is guided into the plane of the door leaf by an additional deflection roller. The solution in accordance with DE 40 15 215 A1 thus is not satisfactory because the increased distance of the door leaf from the plane of the door aperture brings about an increase of installation depth in the area of the door lintel, which compromises the targeted maximum possible compactness of the rolling door in this area. It moreover aggravates problems in terms of sealing between the door leaf and the door lintel or the area of the lateral casements, so that the solution in accordance with DE 40 15 215 A1 is not suited for cases involving confined space conditions.

In contrast, the present invention realizes a rolling door whose dimensions in the area of the door lintel are optimized both with regard to structural height and installation depth.

The motor may moreover be coupled directly to the drive shaft to thereby do away with the use of additional driving means and achieve a particularly energy-efficient, low-maintenance and reliable construction.

Alternatively it is also possible for the motor to be connected to the drive shaft through the intermediary of driving means such as gearwheels, toothed belts, chains, or the like. This construction type is advantageous particularly if the space conditions necessitate an arrangement of the motor at a spacing from the drive shaft, or if free positioning of the motor is desired for other reasons. Even in these cases it is possible to establish a reliable driving connection in a manner known per se.

When the motor is arranged laterally adjacent the range of movement of the door leaf in the transversal direction of the door, an impairment of the structural height or of the installation depth of the rolling door in the area of the door lintel due to the dimensions of the motor can be avoided, so that particularly favorable overall conditions in terms of these dimensions are achieved. This variant can be used where the construction space in the area of the door lintel proper is limited, but sufficient space for disposing the motor nevertheless exists laterally adjacent the rolling door.

In accordance with another aspect of the invention, the set task is achieved through a rolling door comprising: a door leaf which covers a door aperture when the rolling door is in the closed condition, guides arranged on both sides of the door leaf for guiding the door leaf in them, wherein the guides each comprise a vertical portion associated to the door aperture and a spiral portion associated to a door lintel, and wherein the door leaf is received in the spiral portions in the form of non-contacting winding layers when the rolling door is in the opened condition, and a drive mechanism for operating the rolling door which comprises a motor, a drive shaft and drive organs, wherein the drive organs are arranged on both sides of the door leaf and act on the door leaf for the purpose of introducing the drive force, and wherein the drive shaft establishes a driving connection between the drive organs, wherein the drive shaft is arranged in the central area of the spiral portions of the guides of both sides and extends from one side of the door to the other one.

DESCRIPTION OF THE DRAWINGS

The invention shall in the following be explained in more detail by way of practical examples while making reference to the drawings, wherein:

In accordance with the representation in FIG. 1, a rolling door 1 executed as a lifting door comprises a door leaf 2 which is received between two lateral door casements 3 and 4. FIG. 1 shows the rolling door 1 in the closed condition. In the door casements 3 and 4, guides 5 and 6 are arranged which jointly determine the range of movement of the door leaf 2. The rolling door 1 is driven by a drive mechanism 7.

DETAILED DESCRIPTION

Figure 1:
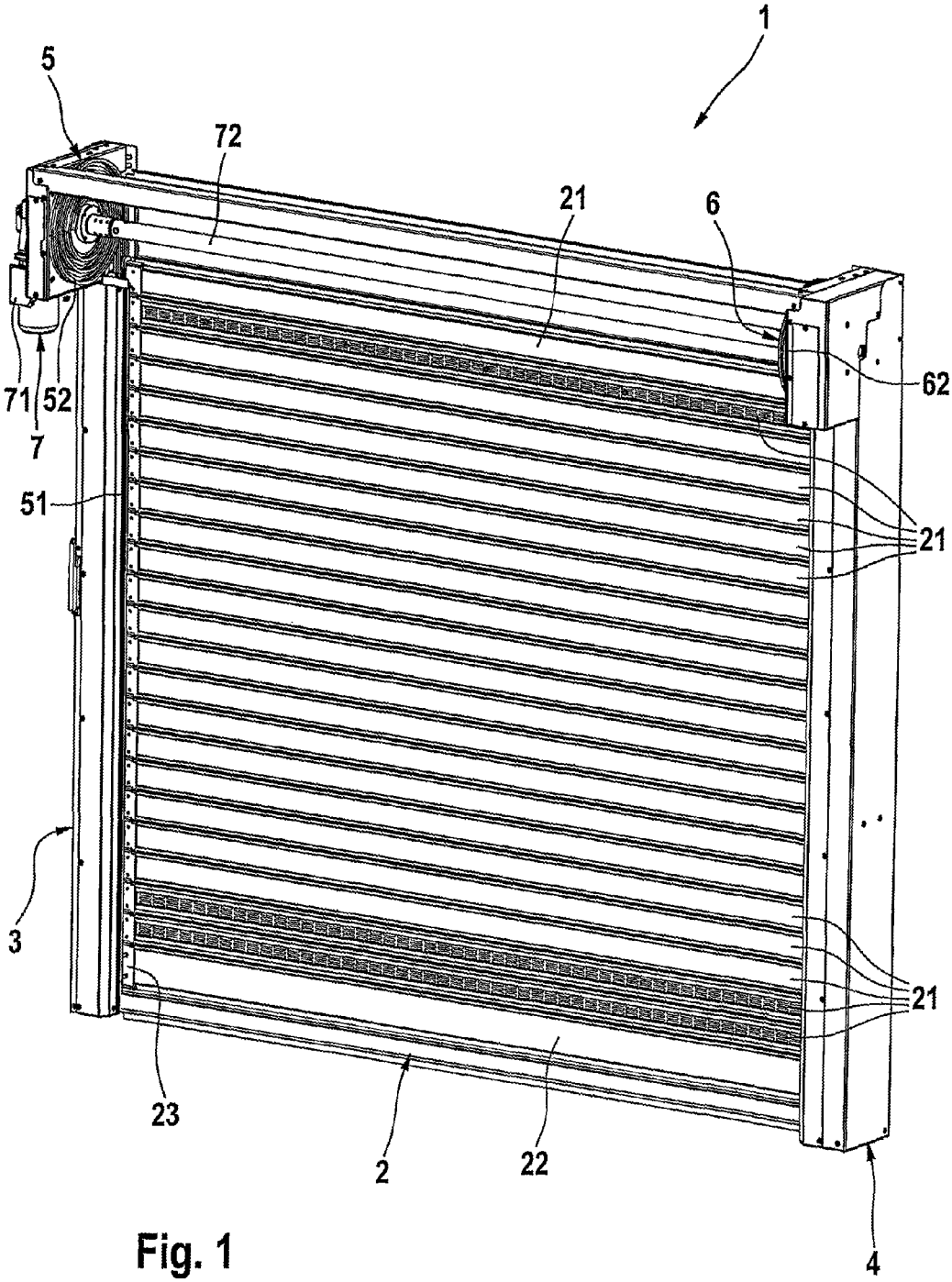
FIG. 1 is a perspective representation of a rolling door of the invention.

The invention relates to a rolling door, in particular a fast-moving industrial door or gate comprising a door leaf which covers a door aperture when the rolling door is in the closed condition, guides arranged on both sides of the door leaf for guiding the door leaf in them, wherein the guides each comprise a vertical portion associated to the door aperture and a spiral portion associated to a door lintel, and wherein the door leaf is received in the spiral portions in the form of non-contacting winding layers when the rolling door is in the opened condition, and a drive mechanism for operating the rolling door which comprises a motor, a drive shaft and drive organs, wherein the drive organs are arranged on both sides of the door leaf and act on the door leaf for the purpose of introducing the drive force, and wherein the drive shaft establishes a driving connection between the drive organs.

The like rolling doors are variously used in practice and have found excellent acceptance. Due to the lateral reception of the door leaf in guides and contact-free winding of the winding layers of the door leaf in the spiral portions, such rolling doors are in particular also suited for high-speed operation at velocities, e.g., of more than 3 meters per second. Moreover the spiral portions of the guides allow a relatively compact accommodation of the door leaf when the rolling door is in the opened condition, so that the required construction space, for example along the ceiling in a direction away from the door lintel, is relatively small. Examples of such fast-moving industrial doors have become known form German patent applications DE 40 15 214 A1, DE 40 15 215 A1, and DE 40 15 216 A1, wherein the fast moving spiral door is realized as a burglary-proof and weather resistant external door. There, the spiral portions are configured such as to result in an elongate coil of the door leaf in the area of the door lintel when rolling door is open.

In the present practical example, the door leaf 2 comprises a multiplicity of slats 21 (some of which are designated in FIG. 1 by way of example) as well as a terminating member 22 arranged on the floor side. The slats 21 and the terminating member 22 are connected to each other by means of hinge straps 23 arranged on both sides in vicinity of the guides 5 and 6. These hinge straps 23 extend substantially over the entire height of the door leaf. As may be seen more clearly in the detail view of FIG. 2, the door leaf 2 further comprises rollers 24 which are coupled to the pivoting axes of the hinge straps 23 and which allow the door leaf 2 to run inside the guides 5 and 6.

Figure 2:
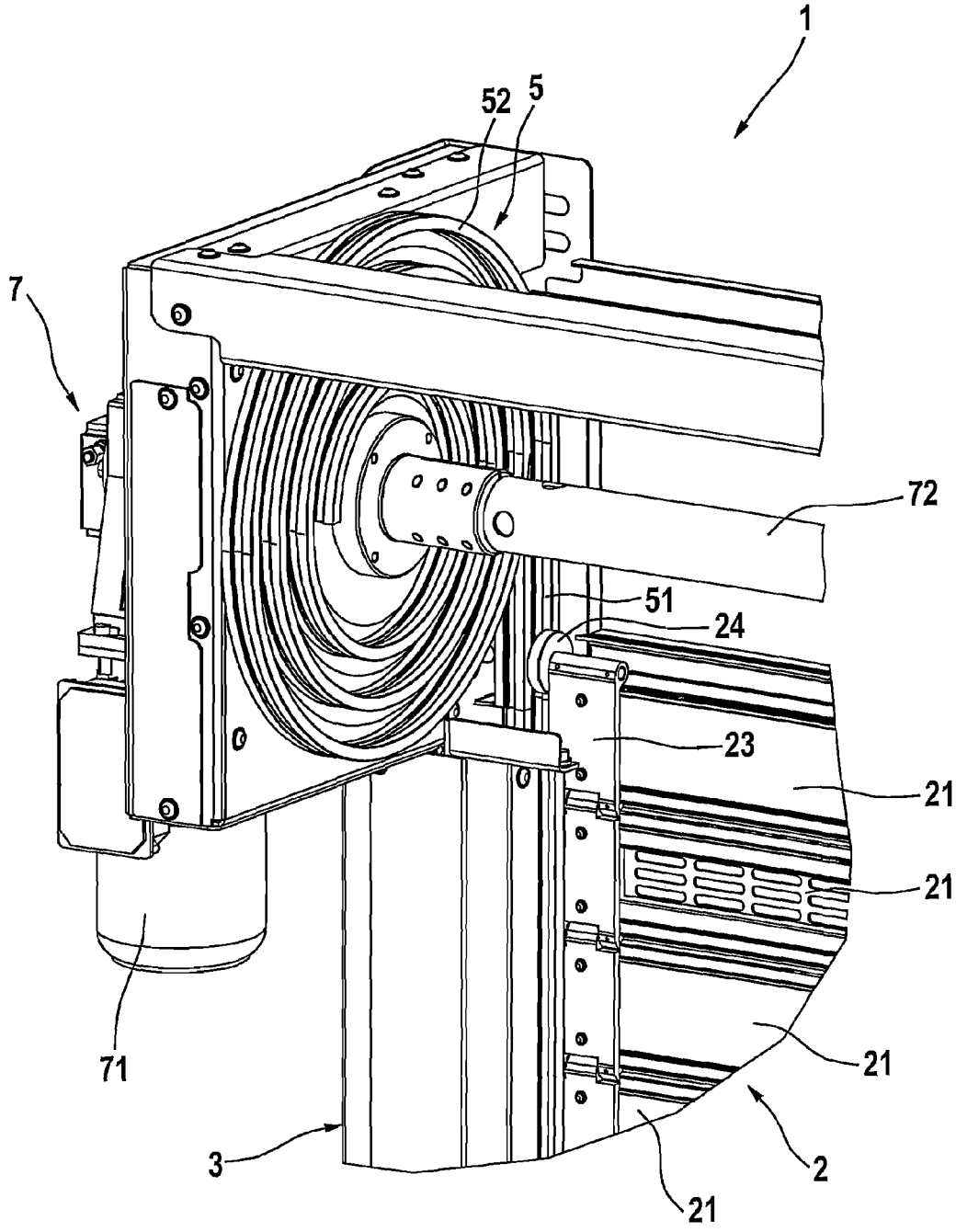
FIG. 2 shows a detail of the representation in FIG. 1.
Figure 3:
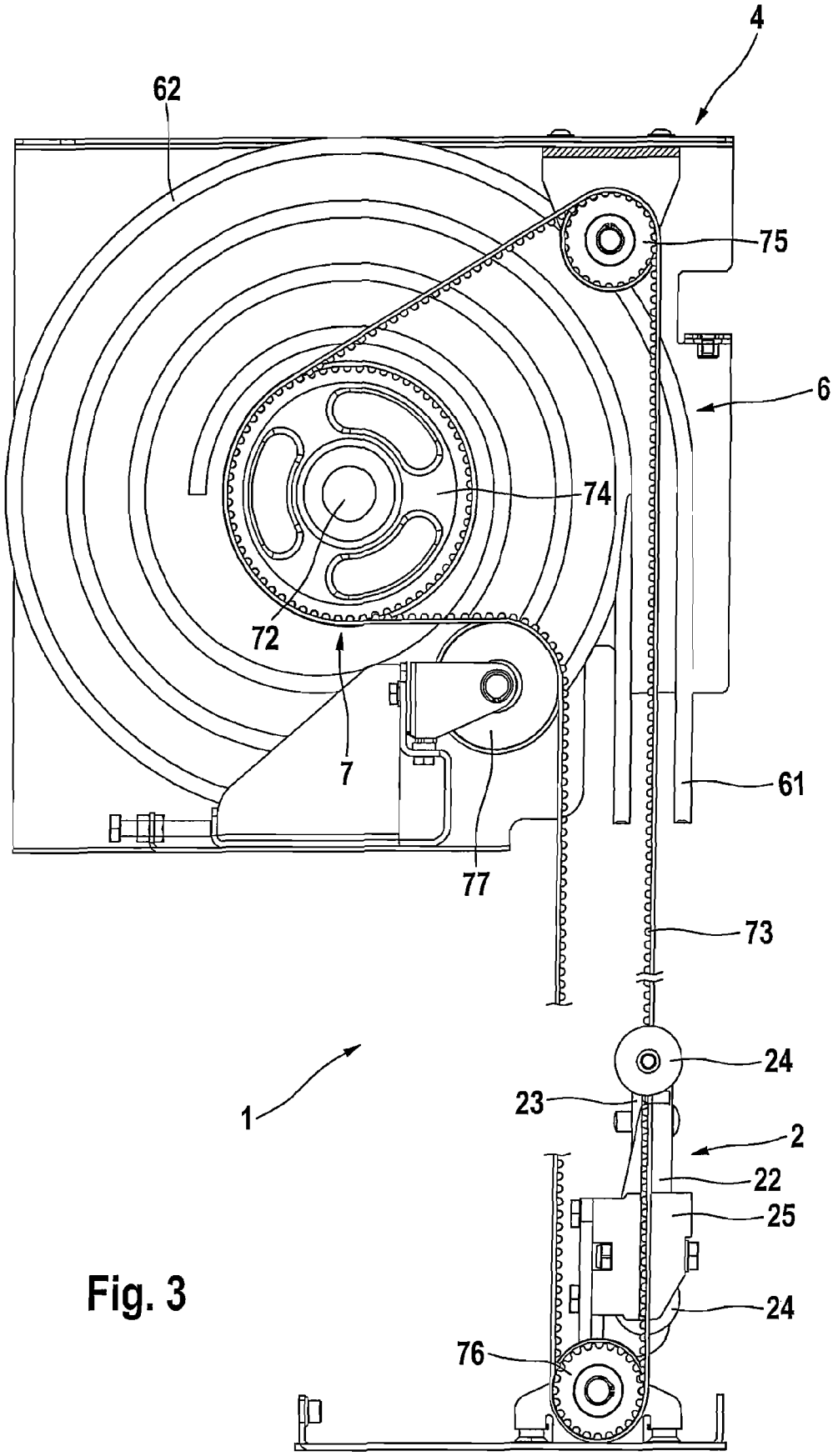
FIG. 3 is a schematic side view of the rolling door of the invention with the side facing of a door casement being omitted.

The guides 5 and 6 are configured in mirror symmetry with each other and each comprise a vertical portion of which only the vertical portion 51 is visible in FIGS. 1 and 2, and only the vertical portion 61 is visible in FIG. 3. The guides 5 and 6 further each include a spiral portion 52 and 62 connecting directly to the respective vertical portion 51 and 61. In the condition shown in FIG. 1, the door leaf 2 completely covers a door aperture by being present in the respective vertical portions 51 and 61 of the guides 5 and 6. In the opened condition of the door, the door leaf 2 is received in the spiral portions 52 and 62 such as to be present there in the form of non-contacting winding layers. Insofar, the rolling door 1 substantially corresponds to the basic principle having become known through the industrial door in accordance with DE 199 15 376 A1.

The drive mechanism 7 comprises a motor 71 and a drive shaft 72 which can in particular be seen in FIGS. 1 and 2. The motor 71 is inserted laterally through the outside of the door casement 3 and directly onto the drive shaft 72 to drive the latter. The drive shaft 72 is located in the center of the spiral portions 52 and 62 while interconnecting them. To this end, the drive shaft 72 extends across from one side of the door leaf to the other one, i.e., it interconnects the central areas of the spiral portions 52 and 62.

Further details of the drive mechanism 7 may be taken from the schematic side view of FIG. 3 in which the side facing of the door casement 4 has been omitted for improved visualization. As may be seen therefrom, driving the door leaf 2 is effected with the aid of a drive organ 73 having the form of a toothed belt in the present embodiment. This drive organ 73 is driven by a drive roller 74 which is attached to the drive shaft 72 in a non-rotational manner. In addition, the drive mechanism 7 further comprises an upper deflection roller 75, a lower deflection roller 76, and a central deflection roller 77 which serve to deflect the drive organ 73 in an appropriate manner. In particular it is achieved through the upper deflection roller 75 and the lower deflection roller 76 that the strand of the drive organ 73 facing the door aperture extends substantially within the plane of the door leaf and in particular through the centers of gravity of the hinge straps 23 in the respective vertical portions 51 and 61 of the guides 5 and 6. As a result, the drive force for opening and closing the door leaf 2 is introduced directly into the plane of the door leaf, so that jamming of the door leaf 2 is avoided and low-friction movement thereof in the guides 5 and 6 is ensured.

As may further be seen from FIG. 3, the door leaf 2 indicated only schematically in this figure further comprises a coupling part 25 whereby the drive organ 73 is fixedly connected to the terminating member 22 of the door leaf 2. The introduction of force for drive purposes accordingly takes place at the lower end of the door leaf 2.

This drive system is present on both sides of the rolling door 1 in the door casements 3 and 4. The drive organ 73 extends laterally adjacent the respective guides 5 and 6 on the sides thereof facing away from the door leaf 2, i.e., outside the moving range of the door leaf 2. Accordingly, the drive roller 74 as well as the deflection rollers 75, 76, and 77 are also arranged laterally adjacent the guides 5 and 6 in the door casements 3 and 4. The drive shaft 72 directly connects the two drive rollers 74 to each other so that the elements 73 through 77 of the drive mechanism 7, which are arranged on either side at the rolling door 1, are driven in synchronicity. The terminating member 22 of the door leaf 2 in the area of the two lateral guides 5 and 6 is thus also subjected simultaneously to a pulling or pushing force through the intermediary of the respective coupling part 25 acting on it.

In the case of the rolling door 1 shown in the figures, the required structural height in the area of the door lintel is therefore restricted to the largest diameter of the spiral portions 52 and 62. In the shown example, the upper deflection roller 75 is partly situated laterally adjacent the spiral portions 52 and 62 so that no additional structural height in the area of the door lintel is required.

Likewise, the required installation depth of the rolling door 1 into the installation space, i.e., away from the door lintel wall, is also determined essentially by the maximum diameter of the spiral portions 52 and 62. Neither the upper deflection roller 75 nor the lower deflection roller 76 contribute to an increase in installation depth, so that the rolling door 1 has very small dimensions in this direction of dimensioning, as well.

The total width of the rolling door 1 is implicitly determined by the outer walls of the door casements 3 and 4, with the motor 71 being attached on an outer side in the shown example, thereby enlarging the door's width to some extent. As the available space is usually less restricted at the sides of such rolling doors, this does not pose a problem in most applications.

In addition to the discussed embodiment, the invention allows for further design approaches as would be understood by a person of ordinary skill in the art in view of the discussion and figures.

It is thus also possible for the motor 71 to be positioned at a spacing from the drive shaft 72. A driving connection between these may then be established by gearwheels, toothed belts, chains, or other driving means.

It is furthermore also possible to utilize a chain or some other connecting organ instead of the toothed belt serving as the drive organ 73.

The positions of the individual deflection rollers 75 to 77 may be adapted, depending on the individual application, in order to ensure an optimum operation of the rolling door 1.

Instead of the circular spirals it is furthermore also possible to utilize elongated spirals at the spiral portions 52 and 62, as is known, e.g., from DE 40 15 215 A1. However in accordance with the invention, the drive shaft 72 must in this case also be disposed in the central area of the spiral portions. On the other hand it will then be possible to place the position of the drive shaft 72 along the substantially linear portions of the elongated spirals in a location that is the most favorable.

Apart from this it is fundamentally also possible to employ the rolling door of the invention not as a lifting door but in different attitudes of installation. Thus it may, for example, also serve as a horizontal closure for a room, or may also create oblique wall closures.

Finally, the door leaf may also be configured in some other manner different from the segmented armor discussed in the foregoing. Thus, e.g., a reinforced flexible hanging in accordance with DE 102 36 648 A1 may also be utilized.

The invention claimed is:

1. A rolling door comprising:

a door leaf which covers a door aperture when the rolling door is in the closed condition, guides arranged on both sides of the door leaf for guiding the door leaf in them, wherein the guides each comprise a vertical portion associated to the door aperture and a spiral portion associated to a door lintel, and wherein the door leaf is received in the spiral portions in the form of non-contacting winding layers when the rolling door is in the opened condition, and a drive mechanism for operating the rolling door vertically which comprises a motor, a drive shaft, drive rollers, and drive organs comprising traction means, wherein the drive organs are arranged on both sides of the door leaf laterally adjacent the guides and outside the moving range of the door leaf and act on a floor-side end portion of the door leaf for the purpose of introducing a vertical drive force, wherein the drive organs extend substantially within the plane of the door leaf in the area of the vertical portions of the guides, and wherein the drive shaft establishes a driving connection between the drive organs, wherein the drive shaft is arranged in the central area of the spiral portions of the guides of both sides and extends from one side of the door to the other one, each drive roller located at each end of the drive shaft, and wherein the drive organs are each driven by the drive shaft via the drive rollers and deflected by deflection rollers, each of the deflection rollers having an outer diameter smaller than an outer diameter of the drive rollers and located vertically so that an upper surface of the outer diameter of each deflection roller is above an axis of the driveshaft and below an upper outer surface of each spiral portion of the guides, the deflection rollers located horizontally so that the outer diameter of each deflection roller is between the axis of the driveshaft and an outer side surface of each spiral portion of the guides, the deflection rollers located such that the side surface of each deflection roller directs a strand of each of the drive organs facing the door aperture to extend substantially within the plane of the door leaf.

2. The rolling door as claimed in claim 1, wherein the motor is coupled directly to the drive shaft.

3. The rolling door as claimed in claim 1, wherein the motor is connected to the drive shaft through an intermediary comprising one of gearwheels, toothed belts, or chains.

4. The rolling door as claimed in claim 1, wherein the motor is arranged laterally adjacent the range of movement of the door leaf in the transversal direction of the door.

5. A rolling door comprising:

a door leaf which covers a door aperture when the rolling door is in the closed condition, guides arranged on both sides of the door leaf for guiding the door leaf in them, wherein the guides each comprise a vertical portion associated to the door aperture and a spiral portion associated to a door lintel, and wherein the door leaf is received in the spiral portions in the form of non-contacting winding layers when the rolling door is in the opened condition, and a drive mechanism for operating the rolling door which comprises a motor, a drive shaft, drive rollers, and drive organs, wherein the drive organs are arranged on both sides of the door leaf and act on the door leaf for the purpose of introducing a vertical drive force, and wherein the drive shaft establishes a driving connection between the drive organs, wherein the drive shaft is arranged in the central area of the spiral portions of the guides of both sides and extends from one side of the door to the other one each drive roller located at each end of the drive shaft, each drive organs are driven by the drive shaft via the drive rollers and deflected by deflection rollers, each of the deflection rollers having an outer diameter smaller than an outer diameter of the drive rollers and located vertically so that an upper surface of the outer diameter of each deflection roller is above an axis of the drive shaft and below an upper outer surface of each spiral portion of the guides, the deflection rollers located horizontally so that the outer diameter of each deflection roller is between the axis of the driveshaft and an outer side surface of each spiral portion of the guides, the deflection rollers located such that the side surface of each deflection roller directs a strand of each of the drive organs facing the door aperture to extend substantially within the plane of the door leaf.

6. The rolling door as claimed in claim 5, wherein the drive organs act on a floor-side end portion of the door leaf for the purpose of introducing the drive force.

7. The rolling door as claimed in claim 5, wherein the drive organs comprise traction means.

8. The rolling door as claimed in claim 7, wherein the drive organs are toothed belts.

* * * * *

UNITED STATES PATENT AND TRADEMARK OFFICE

CERTIFICATE OF CORRECTION

PATENT NO. : 8,899,297 B2
APPLICATION NO. : 12/943658
DATED : December 2, 2014
INVENTOR(S) : Andrej Mazej et al.

It is certified that error appears in the above-identified patent and that said Letters Patent is hereby corrected as shown below:

In the Specification

In Column 3, Line 16, with deflective rollers, etc. should read --with deflection rollers, etc.--

Signed and Sealed this
Twenty-first Day of April, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,899,297 B2
APPLICATION NO. : 12/943658
DATED : December 2, 2014
INVENTOR(S) : Andrej Mazej et al.

It is certified that error appears in the above-identified patent and that said Letters Patent is hereby corrected as shown below:

ON THE TITLE PAGE

Item (75) Inventors, the first name of inventor "Joze Breznikar" should be changed to --Joe Breznikar--

Item (73) Assignee, the Assignee name should be changed from "Efaflex Inzeniring D.O.O. Ljubljana" to --Efaflex Ineniring D.O.O., Ljubljana--

Signed and Sealed this
Twenty-sixth Day of April, 2016

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 8,899,297 B2
APPLICATION NO. : 12/943658
DATED : December 2, 2014
INVENTOR(S) : Andrej Mazej et al.

It is certified that error appears in the above-identified patent and that said Letters Patent is hereby corrected as shown below:

ON THE TITLE PAGE

Item (75) Inventors, the name of inventor "Joze Breznikar" should be changed to --Jože Breznikar--

Item (73) Assignee, the Assignee name should be changed from "Efaflex Inzeniring D.O.O. Ljubljana" to --Efaflex Inženiring D.O.O., Ljubljana--

This certificate supersedes the Certificate of Correction issued April 26, 2016.

Signed and Sealed this
Twenty-fourth Day of May, 2016

Michelle K. Lee

Michelle K. Lee
*Director of the United States Patent and Trademark Office*